US009369810B2

(12) United States Patent
Kamitani et al.

(10) Patent No.: US 9,369,810 B2
(45) Date of Patent: Jun. 14, 2016

(54) ACOUSTIC GENERATOR, ACOUSTIC GENERATION DEVICE, AND ELECTRONIC DEVICE

(71) Applicant: KYOCERA Corporation, Kyoto-shi, Kyoto (JP)

(72) Inventors: Satoru Kamitani, Kirishima (JP); Shigenobu Nakamura, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 14/374,994

(22) PCT Filed: Sep. 26, 2013

(86) PCT No.: PCT/JP2013/076150
§ 371 (c)(1),
(2) Date: Jul. 28, 2014

(87) PCT Pub. No.: WO2014/051006
PCT Pub. Date: Apr. 3, 2014

(65) Prior Publication Data

US 2015/0003646 A1 Jan. 1, 2015

(30) Foreign Application Priority Data

Sep. 26, 2012 (JP) ..... 2012-212364

(51) Int. Cl.
*H04R 1/00* (2006.01)
*H04R 19/02* (2006.01)
(Continued)

(52) U.S. Cl.
CPC ..... *H04R 19/02* (2013.01); *H04R 1/2888* (2013.01); *H04R 7/04* (2013.01); *H04R 7/22* (2013.01); *H04R 17/00* (2013.01); *H04R 2400/11* (2013.01)

(58) Field of Classification Search
CPC ..... H04R 7/04; H04R 7/045; H04R 7/16; H04R 7/18; H04R 7/24
See application file for complete search history.

(56) References Cited

U.S. PATENT DOCUMENTS 3,464,514 A * 9/1969 Ishimura et al. ..... H04R 7/04 181/157
3,570,626 A * 3/1971 Mochida ..... H04R 7/04 181/164

(Continued)

FOREIGN PATENT DOCUMENTS

JP 2004-023436 A 1/2004
JP 2006-186850 A 7/2006
JP 2012-110018 A 6/2012

OTHER PUBLICATIONS

International Search Report, PCT/JP2013/076150, Nov. 25, 2013, 1 pg.

*Primary Examiner* — Curtis Kuntz
*Assistant Examiner* — Ryan Robinson
(74) *Attorney, Agent, or Firm* — Volpe and Koenig, P.C.

(57) ABSTRACT

An object is to provide a preferable frequency characteristic of a sound pressure. For achieving the object, an acoustic generator according to an embodiment includes a piezoelectric element (exciter), a flat vibration plate, and a frame body. The piezoelectric element receives input of an electric signal and vibrates. The piezoelectric element is attached to the vibration plate, and the vibration plate vibrates together with the piezoelectric element with the vibration of the piezoelectric element. The frame body is provided on an outer circumferential portion of the vibration plate. Corners on an inner circumferential surface of the frame body include at least curved surfaces, and at least one of the corners has a shape different from the shape of the other corners.

12 Claims, 7 Drawing Sheets

(51) Int. Cl.

| | |
|---|---|
| ***H04R 1/28*** | (2006.01) |
| *H04R 7/04* | (2006.01) |
| *H04R 17/00* | (2006.01) |
| *H04R 7/22* | (2006.01) |

(56) References Cited

U.S. PATENT DOCUMENTS 4,997,058 A * 3/1991 Bertagni ..... H04R 1/26 181/144
7,475,598 B2 * 1/2009 Starnes ..... G01L 1/10 181/157
8,942,393 B2 * 1/2015 Yamauchi ..... H04R 17/00 381/173
2006/0140438 A1 6/2006 Kimura et al.
2006/0150221 A1 * 7/2006 Chan ..... H04N 7/163 725/81
2011/0317868 A1 * 12/2011 Tsujii ..... H04R 7/16 381/400
2013/0094681 A1 4/2013 Fukuoka et al.

* cited by examiner

ACOUSTIC GENERATOR, ACOUSTIC GENERATION DEVICE, AND ELECTRONIC DEVICE

CROSS REFERENCE TO RELATED APPLICATIONS

This application is national stage application of International Application No. PCT/JP2013/076150, filed on Sep. 26, 2013, which designates the United States, incorporated herein by reference, and which claims the benefit of priority from Japanese Patent Application NO. 2012-212364, filed on Sep. 26, 2012, the entire contents of which are incorporated herein by reference.

FIELD OF INVENTION

Disclosed embodiments relate to an acoustic generator, an acoustic generation device, and an electronic device.

BACKGROUND

Conventionally, acoustic generators that use a piezoelectric element have been known (for example, see Patent Literature 1). The acoustic generators vibrate a vibration plate by applying a voltage to the piezoelectric element attached to the vibration plate and vibrating the piezoelectric element, and output sound by using resonance of the vibration positively.

The acoustic generators can use a thin film such as a resin film for the vibration plate. This enables the acoustic generators to be reduced in thickness and weight in comparison with common electromagnetic speakers and the like.

When the thin film is used for the vibration plate, the thin film is required to be supported in an evenly tensioned state by being held between a pair of frame members in the thickness direction, for example, in order to obtain excellent sound transduction efficiency.

CITATION LIST

Patent Literature

Patent Literature 1: Japanese Patent Application Laid-open No. 2004-023436

SUMMARY

Technical Problem

The above-mentioned conventional acoustic generators use the resonance of the vibration plate in the evenly tensioned state positively. Due to this, there arises the following problem. That is, peaks (at which sound pressure is higher than those in the surrounding) and dips (at which sound pressure is lower than those in the surrounding) are easy to be generated in the frequency characteristic of the sound pressure and preferable sound quality is difficult to be obtained.

Solution to Problem

An acoustic generator according to an aspect of an embodiment includes an exciter, a flat vibration plate, and a frame body. The exciter receives input of an electric signal and vibrates. The exciter is attached to the vibration plate, and the vibration plate vibrates together with the exciter with the vibration of the exciter. The frame body is provided on an outer circumferential portion of the vibration plate. Corners on an inner circumferential surface of the frame body include at least curved surfaces, and at least one of the corners has a shape different from the shape of the other corners.

Moreover, an acoustic generation device according to an aspect of the embodiment includes the acoustic generator and a housing. The housing accommodates the acoustic generator.

Moreover, an electronic device according to an aspect of the embodiment includes the acoustic generator, an electronic circuit, and a case. The electronic circuit is connected to the acoustic generator. The case accommodates the electronic circuit and the acoustic generator. The electronic device has a function of generating sound from the acoustic generator.

Advantageous Effects of Invention

DETAILED DESCRIPTION OF THE PREFERRED EMBODIMENTS

Hereinafter, embodiments of an acoustic generator, an acoustic generation device, and an electronic device that are disclosed by the present application are described in detail with reference to the accompanying drawings. The embodiments, which will be described below, do not limit the invention.

Figure 1A:
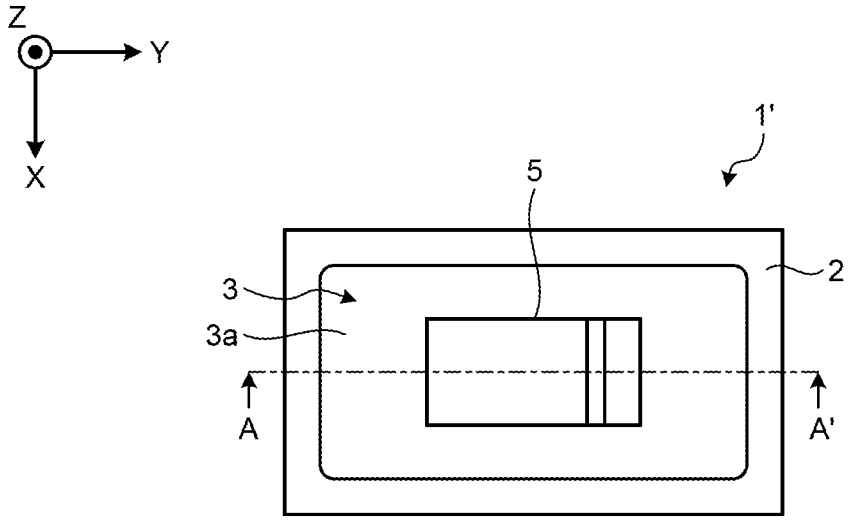
FIG. 1A is a schematic plan view illustrating the schematic configuration of a basic acoustic generator.

First, the schematic configuration of a basic acoustic generator 1' is described with reference to FIG. 1A and FIG. 1B before an acoustic generator 1 in the embodiment is described. FIG. 1A is a schematic plan view illustrating the schematic configuration of the acoustic generator 1' and FIG. 1B is a cross-sectional view cut along line A-A' in FIG. 1A.

Figure 1B:
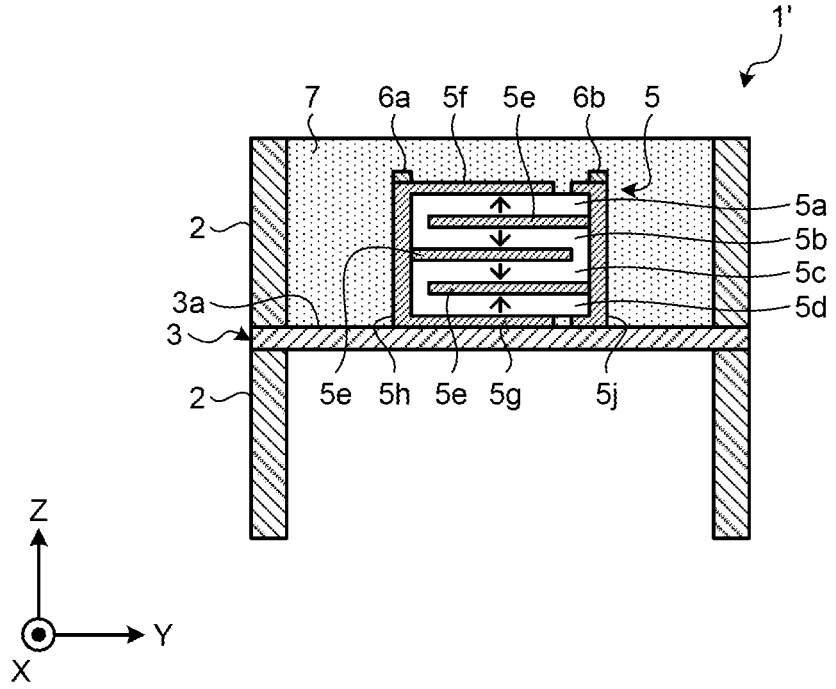
FIG. 1B is a cross-sectional view cut along line A-A' in FIG. 1A.

For easy understanding of the explanation, FIG. 1A and FIG. 1B illustrate a three-dimensional orthogonal coordinate system including a Z axis along which upward vertical direction is set to a positive direction and downward vertical direction is set to a negative direction. The orthogonal coordinate system is also illustrated in other drawings that are used for description later in some cases.

Hereinafter, as for a constituent component constituted by a plurality of components, a reference numeral denotes some of the components only and does not denote others of them in some cases. In such a case, some of the components designated with the reference numeral and others of them have the same configuration.

In FIG. 1A, illustration of a resin layer 7 (which will be described later) is omitted. FIG. 1B illustrates the acoustic generator 1' in the thickness direction (Z-axis direction) in an enlarged and magnified manner for easy understanding of the explanation.

As illustrated in FIG. 1A, the acoustic generator 1' includes a frame body 2, a vibration plate 3, and a piezoelectric element 5 serving as an exciter. Although one piezoelectric element 5 is provided as illustrated in FIG. 1A in the following description, the number of piezoelectric elements 5 is not limited.

The frame body 2 is constituted by two frame members having substantially rectangular frame-like shapes that are the same. The frame body 2 functions as a support member supporting the vibration plate 3 by holding the outer circumferential portion (peripheral edge portion) of the vibration plate 3 between the two frame members. The vibration plate 3 has a plate-like shape or a film-like shape. The outer circumferential portion of the vibration plate 3 is fixed by being held between the two frame members constituting the frame body 2, so that the vibration plate 3 is supported flat in a state of being tensioned evenly in a frame of the frame body 2.

A portion of the vibration plate 3 at the inner side relative to the inner circumference of the frame body 2, that is, a portion of the vibration plate 3 that is not held between the frame members of the frame body 2 and can vibrate freely is assumed to be a vibrator 3*a*. That is to say, the vibrator 3*a* corresponds to a portion having a substantially rectangular shape in the frame of the frame body 2.

The vibration plate 3 can be made of various materials such as a resin and a metal. For example, the vibration plate 3 can be formed by a resin film made of polyethylene, polyimide, or the like that has the thickness of 10 to 200 μm.

The thickness, the material, and the like of the two frame members constituting the frame body 2 are not particularly limited and can be made of various materials such as a resin and a metal. For example, the two frame members constituting the frame body 2 that are made of stainless or the like having the thickness of 100 to 5000 μm can be preferably used from a viewpoint that it is excellent in mechanical strength and corrosion resistance.

FIG. 1A illustrates the frame body 2 of which the inner region has a substantially rectangular shape with rounded corners (that is, including curved surfaces). Alternatively, the inner region of the frame body 2 may have a substantially polygonal shape such as a substantially parallelogram shape, a substantially trapezoidal shape, and a substantially n-sided regular polygonal shape. In the embodiment, the inner region of the frame body 2 is assumed to have the substantially rectangular shape, as illustrated in FIG. 1A. The corners are rounded in this manner, thereby obtaining an advantage that the mechanical strength of the frame body 2 is increased.

Although the frame body 2 is constituted by the two frame members and supports the vibration plate 3 by holding the peripheral edge portion of the vibration plate 3 between the two frame members in the above-mentioned description, the invention is not limited thereto. For example, the frame body 2 may be constituted by one frame member and support the vibration plate 3 by attaching and fixing the peripheral edge portion of the vibration plate 3 to the frame body 2.

The piezoelectric element 5 is an exciter that is provided by being bonded to the surface of the vibration plate 3 (vibrator 3*a*) and so on, and excites the vibration plate 3 (vibrator 3*a*) by receiving application of a voltage and vibrating.

As illustrated in FIG. 1B, the piezoelectric element 5 includes piezoelectric layers 5*a*, 5*b*, 5*c*, and 5*d*, a laminate body, surface electrode layers 5*f* and 5*g*, and external electrodes 5*h* and 5*j*. The piezoelectric layers 5*a*, 5*b*, 5*c*, and 5*d* are formed by four-layered ceramics. The laminate body is formed by alternately laminating three internal electrode layers 5*e*. The surface electrode layers 5*f* and 5*g* are formed on the upper surface and the lower surface, respectively, of the laminate body. The external electrodes 5*h* and 5*j* are formed on the side surfaces to which the internal electrode layers 5*e* are exposed. Furthermore, lead terminals 6*a* and 6*b* are connected to the external electrode 5*h* and 5*j*, respectively.

The piezoelectric element 5 has a plate-like shape and the main surfaces at the upper surface side and the lower surface side thereof have polygonal shapes such as an oblong shape and a square shape. The piezoelectric layers 5*a*, 5*b*, 5*c*, and 5*d* are polarized as indicated by arrows in FIG. 1B. That is to say, they are polarized such that the polarization directions at one side and at the other side in the thickness direction (Z-axis direction in FIG. 1B) with respect to the direction of an electric field applied at one moment are inverted.

When a voltage is applied to the piezoelectric element 5 through the lead terminals 6*a* and 6*b*, the piezoelectric element 5 is deformed such that the piezoelectric layers 5*c* and 5*d* at the side attached to the vibration plate 3 (vibrator 3*a*) contract whereas the piezoelectric layers 5*a* and 5*b* at the upper surface side of the piezoelectric element 5 expand at one moment, for example. That is to say, by applying an alternate-current signal to the piezoelectric element 5, the piezoelectric element 5 vibrates in a bending manner so as to give bending vibration to the vibration plate 3 (vibrator 3*a*).

The main surface of the piezoelectric element 5 is bonded to the main surface of the vibration plate 3 (vibrator 3*a*) with an adhesive formed by an epoxy-based resin or the like.

As a material constituting the piezoelectric layers 5*a*, 5*b*, 5*c*, and 5*d*, conventionally used piezoelectric ceramics such as non-lead-based piezoelectric materials including lead zirconium titanate, Bi laminar compound, and tungsten bronze structure compound can be used.

As a material of the internal electrode layers 5*e*, various metal materials can be used. For example, when the internal electrode layers 5*e* contain a metal component made of silver and palladium and a ceramic component forming the piezoelectric layers 5*a*, 5*b*, 5*c*, and 5*d*, a stress due to a thermal expansion difference between the piezoelectric layers 5*a*, 5*b*, 5*c*, and 5*d* and the internal electrode layers 5*e* can be reduced. This can provide the piezoelectric element 5 with no laminate failure.

The lead terminals 6*a* and 6*b* can be made of various metal materials. For example, when the lead terminals 6*a* and 6*b* are constituted using a flexible wiring formed by sandwiching a metal foil such as copper and aluminum between resin films, the piezoelectric element 5 can be reduced in height.

As illustrated in FIG. 1B, the acoustic generator 1' further includes the resin layer 7 that is filled in the interior of the frame of the frame body 2 so as to cover the surfaces of the piezoelectric element 5 and the vibrator 3*a* and is formed into a layer form.

As the resin layer 7, an acrylic-based resin, an epoxy-based resin, or the like can be used. The resin layer 7 is filled and cured so as to be integrated with the vibrator 3*a* and the piezoelectric element 5. With this process, the resin layer 7, the vibrator 3*a*, and the piezoelectric element 5 constitute one combined vibrator.

An adequate dumping effect can be induced by completely embedding the piezoelectric element 5 in the resin layer 7. This can moderate the resonance phenomenon, thereby obtaining an effect that the peaks and dips in the frequency characteristic of the sound pressure can be moderated to be small.

Although a bimorph stacked piezoelectric element is described as the piezoelectric element 5, as an example, in FIG. 1B, the piezoelectric element 5 is not limited thereto. For example, a unimorph piezoelectric element formed by bonding the piezoelectric element 5 that expands and contracts to the vibration plate 3 (vibrator 3*a*) may be used.

FIG. 1B illustrates the vibration plate 3 (vibrator 3*a*), the piezoelectric element 5, and the resin layer 7. The vibration plate 3 (vibrator 3*a*) is supported flat in a state of being tensioned evenly in the frame of the frame body 2. The piezoelectric element 5 is provided on the surface of the vibration plate 3 (vibrator 3*a*). The resin layer 7 is integrated with the vibration plate 3 (vibrator 3*a*) and the piezoelectric element 5 and is formed by cutting the surface thereof at the height of the frame body 2 so as to be flat.

That is to say, the combined vibrator that is constituted by the vibrator 3*a* of which the outer circumference is defined by the inner circumference of the frame body 2 having the substantially rectangular shape, the piezoelectric element 5, and the resin layer 7 is shaped entirely, and has what is called a symmetric shape. In such a case, peaks and dips or distortion due to resonance induced by the vibration of the piezoelectric element 5 are generated, resulting in drastic change in the sound pressure at specific frequencies. For this reason, the frequency characteristic of the sound pressure is difficult to be flattened.

Figure 2:
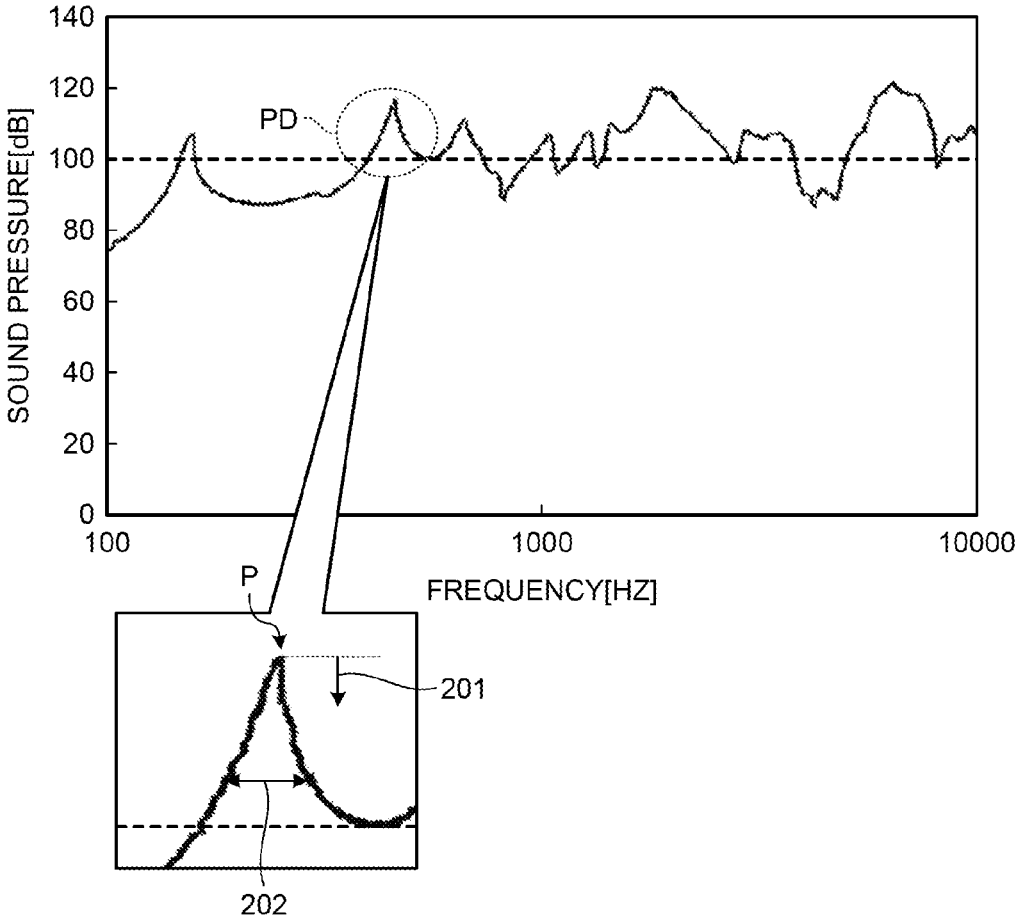
FIG. 2 is a graph illustrating an example of a frequency characteristic of a sound pressure.

This point is described in detail with reference to FIG. 2. FIG. 2 is a graph illustrating an example of the frequency characteristic of the sound pressure. As already described above, when the combined vibrator that is constituted by the vibrator 3*a*, the piezoelectric element 5, and the resin layer 7 is shaped and has the symmetric shape entirely, for example, the vibrator 3*a* and the resin layer 7 have uniform Young's modulus values entirely.

In such a case, the peaks are degenerated at specific frequencies in a concentrated manner due to the resonance of the vibrator 3*a*. Due to this, as illustrated in FIG. 2, steep peaks and dips are easy to be generated in a dispersed manner over the entire frequency region.

As an example, a portion surround by a dashed closed curve PD in FIG. 2 is focused. When a peak P is generated, the sound pressure is varied depending on the frequency. Due to this, preferable sound quality is difficult to be obtained.

In this case, as illustrated in FIG. 2, a measure of lowering the height of the peak P (see, arrow 201 in FIG. 2), enlarging the peak width (see, arrow 202 in FIG. 2) so as to moderate the peak P and a dip (not illustrated) is taken effectively.

In the embodiment, as for the inner circumferential surface of the frame body 2 that defines the outer circumference of the vibrator 3*a*, the shape of at least one corner on the inner circumferential surface is made different from the shape of other corners.

That is to say, the resonance frequency is made uneven partially by making distances from the piezoelectric element 5 to the corners of the frame body 2 different partially and lowering symmetric property of the above-mentioned combined vibrator. With this configuration, the degeneracy of the resonance mode is cancelled and dispersed, and the height of the peak P is lowered and the peak width is enlarged.

Hereinafter, the acoustic generator 1 according to the embodiment is described sequentially in detail with reference to FIG. 3 to FIG. 7. First, FIG. 3 is a schematic plan view illustrating an example of the configuration of the acoustic generator 1 in the embodiment.

Figure 3:
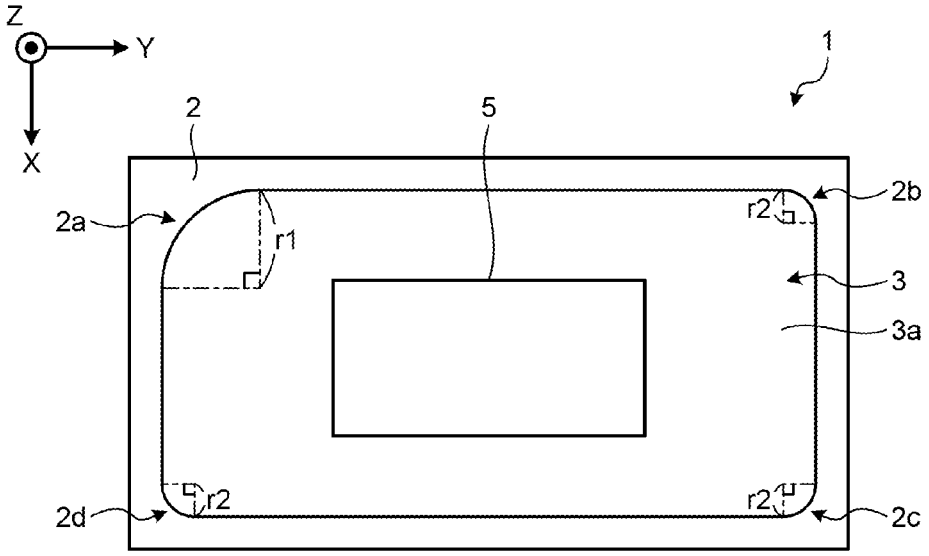
FIG. 3 is a schematic plan view illustrating an example of the configuration of an acoustic generator according to an embodiment.

As illustrated in FIG. 3, the acoustic generator 1 in the embodiment is configured such that the shape of at least one corner on the inner circumferential surface of the frame body 2 is made different from the shape of other corners. For example, FIG. 3 illustrates an example where the curvature radius of a corner 2*a* only is r1 and the curvature radii of other corners 2*b* to 2*d* are r2 among the corners 2*a* to 2*d* each having an R shape with a quarter circular arc curve.

The distance from the piezoelectric element 5 to the corner 2*a* and the distances from the piezoelectric element 5 to the other corners 2*b* to 2*d* can be made asymmetric by making the curvature radius (may be referred to as "curvature" instead) of at least one corner 2*a* different from the curvature radius of the other corners 2*b* to 2*d*. This enables the resonance frequency to be uneven partially.

That is to say, the peaks P of the sound pressure at the resonance points can be varied so as to flatten the frequency characteristic of the sound pressure. This can provide the preferable frequency characteristic of the sound pressure.

Figure 4:
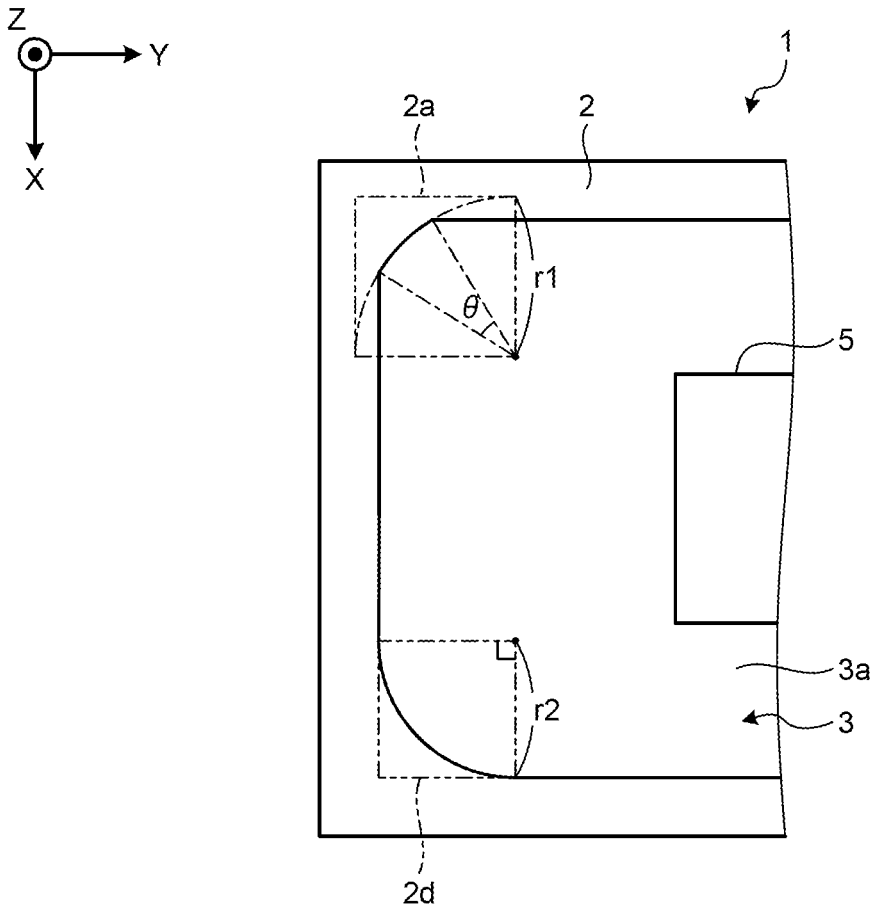
FIG. 4 is a schematic plan view (1) illustrating a formation example of corners of a frame body.

Subsequently, FIG. 4 is a schematic plan view (1) illustrating a formation example of the corners 2*a* to 2*d* of the frame body 2. In FIG. 4, illustration of the corners 2*b* and 2*c* is omitted but the corners 2*b* and 2*c* have the same shape as that of the corner 2*d* as in the case of FIG. 3.

FIG. 3 illustrates the example where all of the corners 2*a* to 2*d* have the R shapes with the quarter circular arc curves, what are called "perfect R" shapes. Alternatively, any of the corners 2*a* to 2*d* may not be formed to have the "perfect R" shape so as to make the shape of at least one corner different.

For example, as illustrated in FIG. 4, the corner 2*a* may be formed with straight lines and a θ/360 circular arc curve having the curvature radius of r1 whereas the corner 2*d* is formed to have a "perfect R" shape having the curvature radius of r2. In such a case, as illustrated in FIG. 4, the corner 2*a* includes more flat surfaces than those of the corners 2*b* to 2*d*, thereby lowering the symmetric property of the combined vibrator. This enables the resonance frequency to be uneven partially.

That is to say, the peaks P of the sound pressure at the resonance points can be varied so as to flatten the frequency characteristic of the sound pressure. This can provide the preferable frequency characteristic of the sound pressure.

Meanwhile, the frame body 2 can be constituted by the two frame members as described above. The shape of at least one corner may be made different by making the shapes of the two frame members different.

Figure 5A:
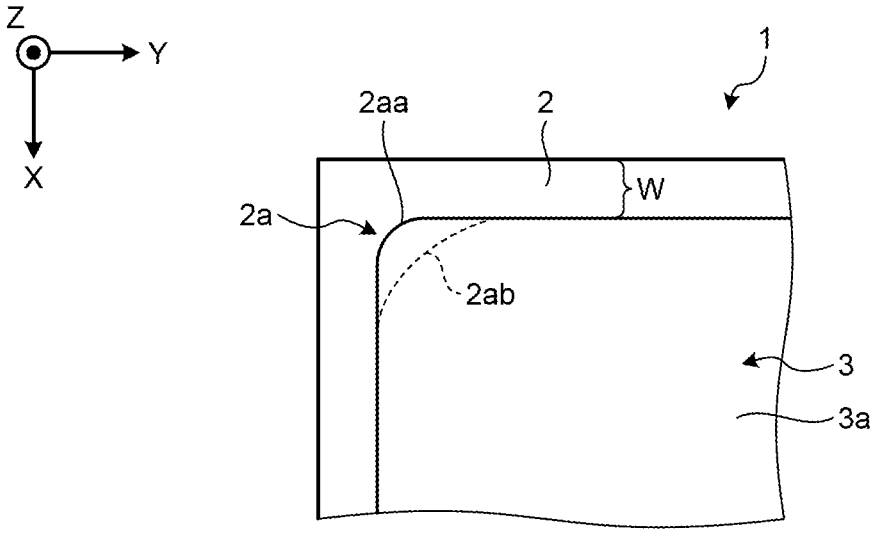
FIG. 5A is a schematic plan view (2) illustrating another formation example of the corners of the frame body.
Figure 5B:
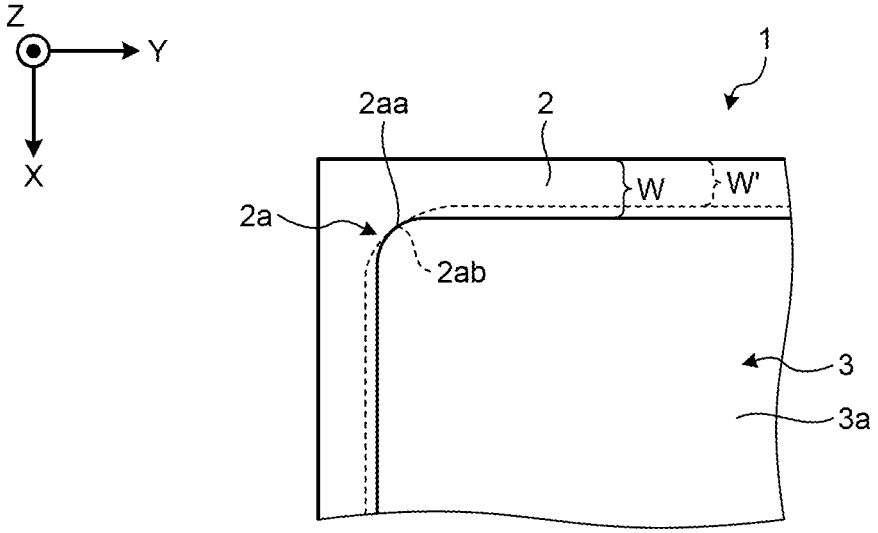
FIG. 5B is a schematic plan view (3) illustrating still another formation example of the corners of the frame body.

FIG. 5A and FIG. 5B are schematic plan views (2) and (3) illustrating formation examples of the corners 2*a* to 2*d* of the frame body 2. Although FIG. 5A and FIG. 5B and FIG. 6 and FIG. 7, which are referred later, omit illustration of the corners 2*b* to 2*d*, the shapes of the corners 2*b* to 2*d* are made different from that of at least the corner 2*a* in the same manner as described above.

For example, the following configuration may be employed as illustrated in FIG. 5A. That is, the frame width W of the frame body 2 is made to be uniform. In this state, a corner 2*aa* of the frame member at the surface side and a corner 2*ab* of the frame member at the rear side in the corner 2*a* are made to have different curvatures.

Alternatively, the following configuration may be also employed as illustrated in FIG. 5B, for example. That is, the frame width W of the frame member at the surface side and the frame width W' of the frame member at the rear side are made different. In this state, the corner 2*a* is configured such that the corner 2*aa* of the frame member at the surface side makes contact with the corner 2*ab* of the frame member at the rear side.

The symmetric property of the combined vibrator can be also lowered by making the shapes of the two frame members different. This enables the resonance frequency to be uneven partially.

That is to say, the peaks P of the sound pressure at the resonance points can be varied so as to flatten the frequency characteristic of the sound pressure. This can provide the preferable frequency characteristic of the sound pressure.

When the shapes of the two frame members are made different, an extent of the difference therebetween is preferably within an allowable range as a tolerance.

Figure 6:
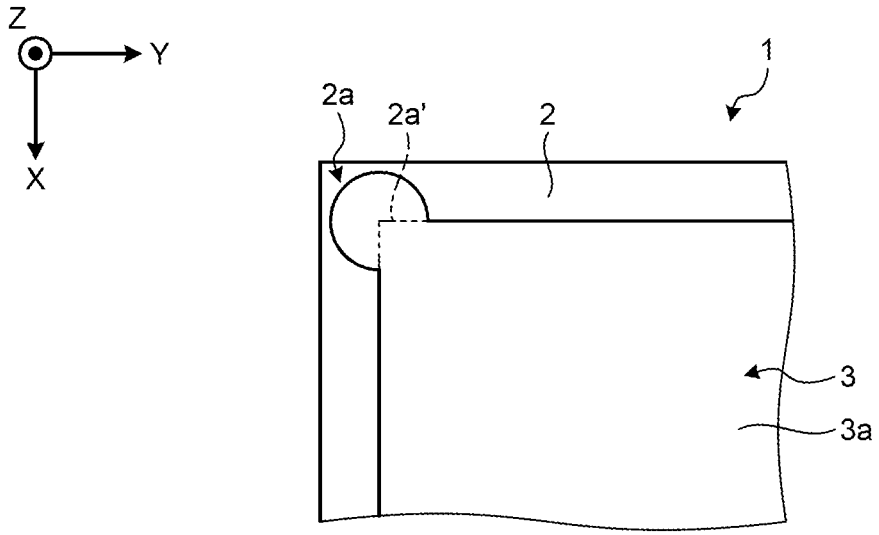
FIG. 6 is a schematic plan view (4) illustrating still another formation example of the corners of the frame body.

FIG. 6 is a schematic plan view (4) illustrating another formation example of the corners 2*a* to 2*d* of the frame body 2. In the above description, the corner 2*a* is at the frame inner side relative to at least a virtual corner 2*a'* that is formed by the two adjacent inner circumferential flat surfaces of the frame body 2. Alternatively, as illustrated in FIG. 6, the corner 2*a* may be formed at the outer side relative to the corner 2*a'*.

That is to say, as illustrated in FIG. 6, at least one corner 2*a* may be formed with a curved surface that is recessed toward the outer circumference side of the frame body 2. This can also lower the symmetric property of the combined vibrator, thereby making the resonance frequency uneven partially.

That is to say, the peaks P of the sound pressure at the resonance points can be varied so as to flatten the frequency characteristic of the sound pressure. This can provide the preferable frequency characteristic of the sound pressure.

Figure 7:
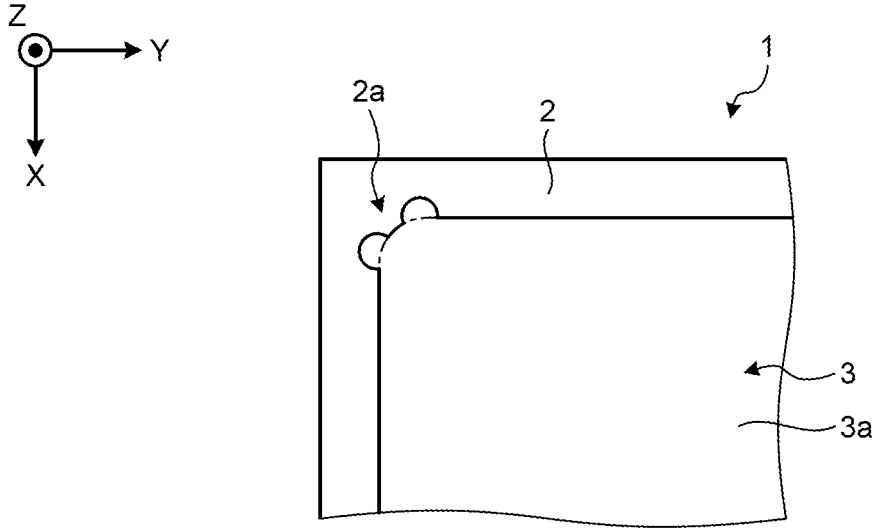
FIG. 7 is a schematic plan view (5) illustrating still another formation example of the corners of the frame body.

Furthermore, the curved surface of at least one corner 2*a* may be further recessed toward the outer circumference side of the frame body 2 partially. FIG. 7 is a schematic plan view (5) illustrating another formation example of the corners 2*a* to 2*d* of the frame body 2.

That is to say, as illustrated in FIG. 7, the corner 2*a* may be configured such that the curved surface (see, two-dot chain line in FIG. 7) of at least one corner 2*a* has a plurality of (for example, two) curved surfaces formed by making the curved surface further recessed toward the outer circumference side of the frame body 2 partially.

The plurality of curved surfaces recessed toward the outer circumference side of the frame body 2 partially are provided as described above. This can complicate the asymmetric property of the combined vibrator, thereby making the resonance frequency uneven partially.

Although the case where only the corner 2*a* has the shape different from the shape of other corners 2*b* to 2*d* has been described above with reference to FIG. 3 to FIG. 7, the invention is not limited thereto. For example, the shapes of the corners 2*a* to 2*d* may be made different as long as the symmetric property as the combined vibrator can be lowered.

Figure 8A:
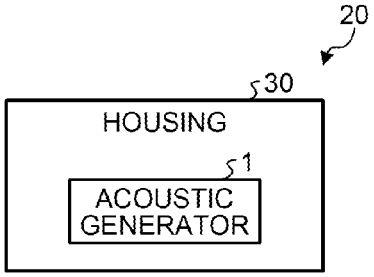
FIG. 8A is a diagram illustrating the configuration of an acoustic generation device according to another embodiment.
Figure 8B:
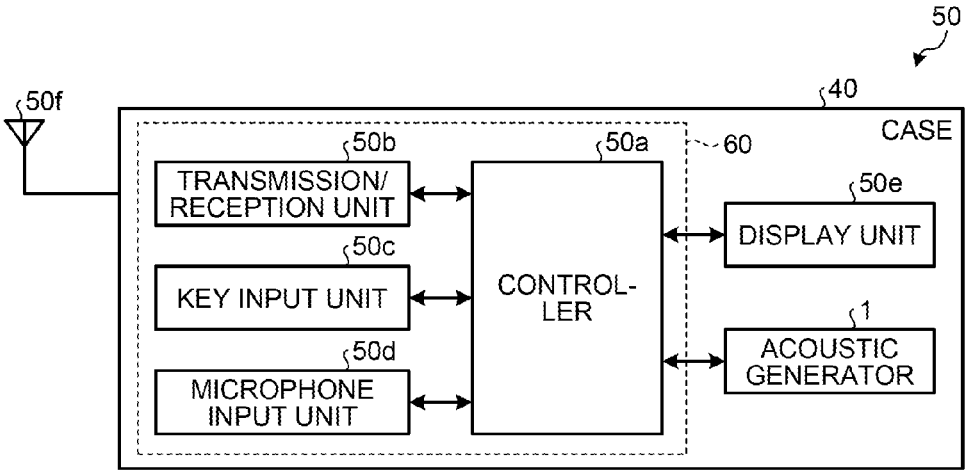
FIG. 8B is a diagram illustrating the configuration of an electronic device according to still another embodiment.

Next, an acoustic generation device and an electronic device on which the acoustic generator 1 according to the embodiment as described above is mounted are described with reference to FIG. 8A and FIG. 8B. FIG. 8A is a diagram illustrating the configuration of an acoustic generation device 20 according to another embodiment and FIG. 8B is a diagram illustrating the configuration of an electronic device 50 according to still another embodiment. Both of the drawings illustrate constituent components necessary for explanation only and omit illustration of common constituent components.

The acoustic generation device 20 is an acoustic generation device such as what is called a speaker, and includes the acoustic generator 1 and a housing 30 accommodating the acoustic generator 1 as illustrated in FIG. 8A. The housing 30 resonates therein sound generated by the acoustic generator 1 and outputs the sound to the outside through an opening (not illustrated) formed on the housing 30. The acoustic generation device 20 includes the housing 30 so as to increase the sound pressure in a low-frequency band, for example.

The acoustic generator 1 can be mounted on the electronic device 50 of various types. For example, in FIG. 8B, the electronic device 50 is assumed to be a mobile terminal apparatus such as a mobile phone and a tablet terminal.

As illustrated in FIG. 8B, the electronic device 50 includes an electronic circuit 60. The electronic circuit 60 is constituted by a controller 50*a*, a transmission/reception unit 50*b*, a key input unit 50*c*, and a microphone input unit 50*d*, for example. The electronic circuit 60 is connected to the acoustic generator 1 and has a function of outputting an audio signal to the acoustic generator 1. The acoustic generator 1 generates sound based on the audio signal input from the electronic circuit 60.

The electronic device 50 includes a display unit 50*e*, an antenna 50*f*, and the acoustic generator 1. The electronic device 50 includes a case 40 accommodating the devices.

Although FIG. 8B illustrates a state where all the devices including the controller 50*a* are accommodated in the one case 40, this does not limit an accommodation form of the devices. In the embodiment, it is sufficient that the one case 40 accommodates at least the electronic circuit 60 and the acoustic generator 1.

The controller 50*a* is a controller of the electronic device 50. The transmission/reception unit 50*b* transmits and receives data through the antenna 50*f* based on control by the controller 50*a*.

The key input unit 50*c* is an input device of the electronic device 50 and receives a key input operation by an operator. The microphone input unit 50*d* is also an input device of the electronic device 50 and receives an audio input operation and the like by the operator.

The display unit 50*e* is a display output device of the electronic device 50 and outputs display information based on control by the controller 50*a*.

The acoustic generator 1 operates as a sound output device in the electronic device 50. The acoustic generator 1 is connected to the controller 50*a* of the electronic circuit 60 and receives application of a voltage controlled by the controller 50*a* so as to generate sound.

Although the electronic device 50 is assumed to be the mobile terminal apparatus in FIG. 8B, it does not limit the type of the electronic device 50 and the electronic device 50 may be applied to various consumer apparatuses having a function of generating sound. For example, it is needless to say that the electronic device 50 may be used for a thin-screen television and a car audio system. In addition, the electronic device 50 may be also used for products having a function of generating sound including "speaking". Examples thereof include various products such as cleaners, washers, refrigerators, and microwaves.

As described above, the acoustic generator in the embodiment includes the exciter (piezoelectric element), the flat vibration plate, and the frame body. The exciter receives input of an electric signal and vibrates. The exciter is attached to the vibration plate, and the vibration plate vibrates together with the exciter with the vibration of the exciter. The frame body is provided on the outer circumferential portion of the vibration plate. The respective corners on the inner circumferential surface of the frame body include at least curved surfaces and at least one of the corners has a different shape from those of other corners.

Accordingly, the acoustic generator in the embodiment can provide a preferable frequency characteristic of the sound pressure.

Although the case where the corners have the R shapes formed with circular arc curves only when seen from the above has been described mainly as an example in the above-mentioned embodiment, it is sufficient that at least local bending manner of the corner is approximate circular. In other words, the corners have schematically rounded shapes with at least curved surfaces.

Although the case where the piezoelectric element is provided on one main surface of the vibration plate has been described mainly as an example in the above-mentioned embodiment, the invention is not limited thereto. Piezoelectric elements may be provided on both the surfaces of the vibration plate.

Although the vibration plate is formed by a thin film such as the resin film as an example in the above-mentioned embodiment, the invention is not limited thereto. For example, the vibration plate may be formed by a plate-like member.

Although the exciter is formed by the piezoelectric element as an example in the above-mentioned embodiment, the exciter is not limited to the piezoelectric element. Any exciter having a function of receiving input of an electric signal and vibrating may be used.

For example, an electrodynamic exciter, an electrostatic exciter, and an electromagnetic exciter that have been known as exciters vibrating a speaker may be used.

The electrodynamic exciter applies an electric current to a coil arranged between magnetic poles of a permanent magnet to vibrate the coil. The electrostatic exciter applies a bias and an electric signal to two opposing metal plates to vibrate the metal plates. The electromagnetic exciter applies an electric signal to a coil to vibrate a thin iron sheet.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention claimed is:

1. An acoustic generator comprising:

an exciter;

a vibration plate to which the exciter is attached and that vibrates together with the exciter with vibration of the exciter; and a frame body that is provided on an outer circumferential portion of the vibration plate, wherein the exciter is provided in a region that does not overlap with a more inner side of the frame body than the outer circumferential portion of the vibration plate, the frame body includes two frame members, with the two frame members holding the outer circumferential portion of the vibration plate therebetween, wherein a plurality of corners on an inner circumferential surface of the two frame members include at least curved surfaces, at least one of the plurality of corners of either or both of the two frame members has a shape different from the shape of the other corners, and a curvature of at least one of the plurality of corners in one of the two frame members is different from the curvature of a corresponding corner in the other frame member.

2. The acoustic generator according to claim 1, wherein the plurality of corners have R shapes with circular arc curves when viewed in a plan view of the frame body, and a curvature of at least one of the plurality of corners in either or both of the two frame members is different from the curvature of the other corners.

3. The acoustic generator according to claim 1, wherein at least one of the plurality of corners in either or both of the two frame members does not have an R shape with a quarter circular arc curve.

4. The acoustic generator according to claim 1, wherein the vibration plate is formed by a resin film.

5. The acoustic generator according to claim 1, wherein the exciter is formed by a bimorph stacked piezoelectric element.

6. An acoustic generation device comprising:

the acoustic generator according to claim 1; and a housing that accommodates the acoustic generator.

7. An electronic device comprising:

the acoustic generator according to claim 1;

an electronic circuit that is connected to the acoustic generator; and a case that accommodates the electronic circuit and the acoustic generator, wherein the electronic device has a function of generating sound from the acoustic generator.

8. An acoustic generator comprising:

an exciter;

a vibration plate to which the exciter is attached and that vibrates together with the exciter with vibration of the exciter; and a frame body that is provided on an outer circumferential portion of the vibration plate, wherein the exciter is provided in a region that does not overlap with a more inner side of the frame body than the outer circumferential portion of the vibration plate, the frame body includes two frame members, with the two frame members holding the outer circumferential portion of the vibration plate therebetween, wherein a plurality of corners on an inner circumferential surface of the two frame members include at least curved surfaces, and a curvature of at least one of the plurality of corners in one of the two frame members is different from the curvature of a corresponding corner in the other frame member.

9. The acoustic generator according to claim 8, wherein the vibration plate is formed by a resin film.

10. The acoustic generator according to claim 8, wherein the exciter is formed by a bimorph stacked piezoelectric element.

11. An acoustic generation device comprising:

the acoustic generator according to claim 8; and a housing that accommodates the acoustic generator.

12. An electronic device comprising:

the acoustic generator according to claim 8;

an electronic circuit that is connected to the acoustic generator; and a case that accommodates the electronic circuit and the acoustic generator, wherein the electronic device has a function of generating sound from the acoustic generator.

* * * * *